US009224324B2

(12) United States Patent
Nadiguebe et al.

(10) Patent No.: US 9,224,324 B2
(45) Date of Patent: Dec. 29, 2015

(54) CASCODE DRIVER CIRCUIT

(71) Applicant: Pixtronix, Inc., San Diego, CA (US)

(72) Inventors: Alain Blaing Nadiguebe, La Jolla, CA (US); Nada Vukovic-Radic, San Diego, CA (US); Didier Henri Farenc, San Diego, CA (US)

(73) Assignee: Pixtronix, Inc., San Diego, CA (US)

( * ) Notice: Subject to any disclaimer, the term of this patent is extended or adjusted under 35 U.S.C. 154(b) by 47 days.

(21) Appl. No.: 14/172,425

(22) Filed: Feb. 4, 2014

(65) Prior Publication Data

US 2015/0194089 A1 Jul. 9, 2015

Related U.S. Application Data

(60) Provisional application No. 61/923,572, filed on Jan. 3, 2014.

(51) Int. Cl.

| | |
|---|---|
| ***G09G 5/00*** | (2006.01) |
| ***G09G 3/20*** | (2006.01) |
| ***G09G 3/34*** | (2006.01) |

(52) U.S. Cl.

CPC ..... *G09G 3/2092* (2013.01); *G09G 3/3433* (2013.01); *G09G 2300/0819* (2013.01); *G09G 2300/0823* (2013.01); *G09G 2300/0842* (2013.01); *G09G 2300/0871* (2013.01); *G09G 2310/027* (2013.01); *G09G 2310/0251* (2013.01); *G09G 2310/0256* (2013.01); *G09G 2310/0262* (2013.01);

(Continued)

(58) Field of Classification Search

CPC ... G09G 3/346; G09G 2310/0264–2310/0297; G09G 3/2092; G09G 3/3433; G09G 2320/0252; G09G 2300/0823; G09G 2300/0819; G09G 2300/0842; G09G 2300/0871; G09G 2310/0251; G09G 2310/0256; G09G 2310/0262; G09G 2330/04

USPC ..... 345/108–111, 214

See application file for complete search history.

(56) References Cited

U.S. PATENT DOCUMENTS 4,384,287 A * 5/1983 Sakuma ..... 345/60
5,583,454 A 12/1996 Hawkins et al.

(Continued)

FOREIGN PATENT DOCUMENTS

EP 2538560 A1 12/2012

OTHER PUBLICATIONS

International Search Report and Written Opinion—PCT/US2014/072497—ISA/EPO—Mar. 17, 2015.

*Primary Examiner* — Stephen Sherman

(74) *Attorney, Agent, or Firm* — Edward A. Gordon; Foley & Lardner LLP

(57) ABSTRACT

This disclosure provides systems, methods, and apparatus for providing a cascode driver circuit for providing positive and negative polarities of two or more voltages at an output node. The voltages provided by the cascode driver circuit can be used to provide voltages to various interconnects and terminals of the display apparatus. The cascode driver circuit includes a first circuit for providing a positive polarity of two or more voltages to an output node via a first set of cascode transistors and a second circuit for providing negative polarities of the two or more voltages via a second set of cascode transistors. The driver circuit includes body-effect mitigation circuitry for reducing the impact of body-effect on the performance of the driver circuit. The driver circuit also includes circuitry for reducing substrate leakage current.

19 Claims, 10 Drawing Sheets

(52) U.S. Cl.
CPC ..... *G09G 2310/0289* (2013.01); *G09G 2310/0291* (2013.01); *G09G 2320/0252* (2013.01); *G09G 2330/04* (2013.01)

(56) References Cited

U.S. PATENT DOCUMENTS

| | | | | |
|---|---|---|---|---|
| 5,610,533 | A | 3/1997 | Arimoto et al. | |
| 5,748,025 | A | 5/1998 | Ng et al. | |
| 5,786,724 | A | 7/1998 | Teggatz | |
| 6,707,755 | B1 | 3/2004 | Somasekhar et al. | |
| 6,831,518 | B2 | 12/2004 | Blankenship et al. | |
| 2003/0169360 | A1* | 9/2003 | Rhodes | 348/308 |
| 2007/0159249 | A1 | 7/2007 | Nishimura et al. | |
| 2007/0262810 | A1 | 11/2007 | Lee et al. | |
| 2010/0328286 | A1 | 12/2010 | Piasecki et al. | |
| 2013/0141474 | A1 | 6/2013 | Kim | |
| 2013/0176611 | A1 | 7/2013 | Lewis et al. | |
| 2014/0252410 | A1* | 9/2014 | Laschek-Enders | 257/141 |

* cited by examiner

CASCODE DRIVER CIRCUIT

RELATED APPLICATION

The present Application for Patent claims priority to U.S. Provisional Patent Application No. 61/923,572, entitled "CASCODE DRIVER CIRCUIT," filed Jan. 3, 2014, and hereby expressly incorporated by reference herein.

TECHNICAL FIELD

This disclosure relates to the field of imaging displays, and in particular to driver circuits for display elements.

DESCRIPTION OF THE RELATED TECHNOLOGY

Electromechanical systems (EMS) devices include devices having electrical and mechanical elements, such as actuators, optical components (such as mirrors, shutters, and/or optical film layers) and electronics. EMS devices can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of deposited material layers, or that add layers to form electrical and electromechanical devices.

EMS-based display apparatus have been proposed that include display elements that modulate light by selectively moving a light blocking component into and out of an optical path through an aperture defined through a light blocking layer. Doing so selectively passes light from a backlight or reflects light from the ambient or a front light to form an image.

SUMMARY

The systems, methods and devices of the disclosure each have several innovative aspects, no single one of which is solely responsible for the desirable attributes disclosed herein.

One innovative aspect of the subject matter described in this disclosure can be implemented in an apparatus including an output node and a driver circuit coupled to the output node. The driver circuit includes a first circuit, including a first set of cascode transistors, for selectively providing at least two voltage levels with a first polarity to the output node via the first set of cascode transistors, and a second circuit, including a second set of cascode transistors, for selectively providing a second polarity, opposite to the first polarity, of each of the at least two voltage levels to the output node via the second set of cascode transistors.

In some implementations, the first circuit includes a first switch configured to selectively couple a bulk terminal of at least one of the first set of cascode transistors to substantially the same voltage as that of its source terminal. In some such implementations, the voltage at the source terminal of the at least one of the first set of cascode transistors is substantially equal to one of the at least two voltage levels with the first polarity.

In some implementations, the second circuit includes a second switch configured to selectively couple a bulk terminal of at least one of the second set of cascode transistors to substantially the same voltage as that of its source terminal. In some such implementations, the voltage at the source terminal of the at least one of the second set of cascode transistors is substantially equal to the one of the at least two voltage levels with the second polarity.

In some implementations, the first circuit includes a switch configured to couple both a bulk terminal and a source terminal of one of the first set of cascode transistors to a relatively lower magnitude voltage when the second circuit is providing the second polarity of one of the at least two voltage levels to the output node. In some implementations, one of the first set of cascode transistors and one of the second set of the cascode transistors are directly coupled to the output node. In some implementations, the first set of cascode transistors are p-type metal-oxide-semiconductor transistors and the second set of cascode transistors are n-type metal-oxide-semiconductor transistors.

In some implementations, the apparatus further includes a display including an array of the display elements, one or more driver circuits, a processor that is capable of communicating with the display, the processor being capable of processing image data, and a memory device that is capable of communicating with the processor. In some such implementations, the display further includes a driver circuit capable of sending at least one signal to the display, and a controller capable of sending at least a portion of the image data to the driver circuit. In some other such implementations, the apparatus further includes an image source module capable of sending the image data to the processor, where the image source module includes at least one of a receiver, transceiver, and transmitter. In some other such implementations, the display device further includes an input device capable of receiving input data and to communicate the input data to the processor.

Another innovative aspect of the subject matter described in this disclosure can be implemented in a method for providing voltages at an output node, the method including selectively providing at least two voltage levels with a first polarity to the output node via a first set of cascode transistors, and selectively providing a second polarity, opposite to the first polarity, of each of the at least two voltage levels to the output node via a second set of cascode transistors.

In some implementations, selectively providing at least two voltage levels with a first polarity to the output node via a first set of cascode transistors includes selectively coupling a bulk terminal of at least one of the first set of cascode transistors to substantially the same voltage as that of its source terminal. In some implementations, selectively providing a second polarity, opposite to the first polarity, of each of the at least two voltage levels to the output node via a second set of cascode transistors includes selectively coupling a bulk terminal of at least one of the second set of cascode transistors to substantially the same voltage as that of its source terminal. In some other implementations, selectively providing a second polarity, opposite to the first polarity, of each of the at least two voltage levels to the output node via a second set of cascode transistors includes coupling a bulk terminal and a source terminal of one of the first set of cascode transistors to a relatively lower magnitude voltage.

Another innovative aspect of the subject matter described in this disclosure can be implemented in a driver circuit for providing a plurality of voltage to an array of display elements. The driver circuit includes first means for selectively providing at least two voltage levels with a first polarity to an output node via a first set of cascode transistors, and second means for selectively providing a second polarity, opposite to the first polarity, of each of the at least two voltage levels to the output node via a second set of cascode transistors.

In some implementations, the first and second means each includes one or more transistors, and the driver circuit further includes means for reducing impact of body-effect of the one or more transistors. In some other implementations, the driver circuit further includes a substrate on which the first means is resident on, and means for reducing a substrate leakage current of the first means.

Details of one or more implementations of the subject matter described in this specification are set forth in the accompanying drawings and the description below. Although the examples provided in this summary are primarily described in terms of electromechanical systems (EMS) based displays, the concepts provided herein may apply to other types of displays, such as liquid crystal displays (LCDs), organic light-emitting diode (OLED) displays, electrophoretic displays, and field emission displays, as well as to other non-display EMS devices, such as EMS microphones, sensors, and optical switches. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
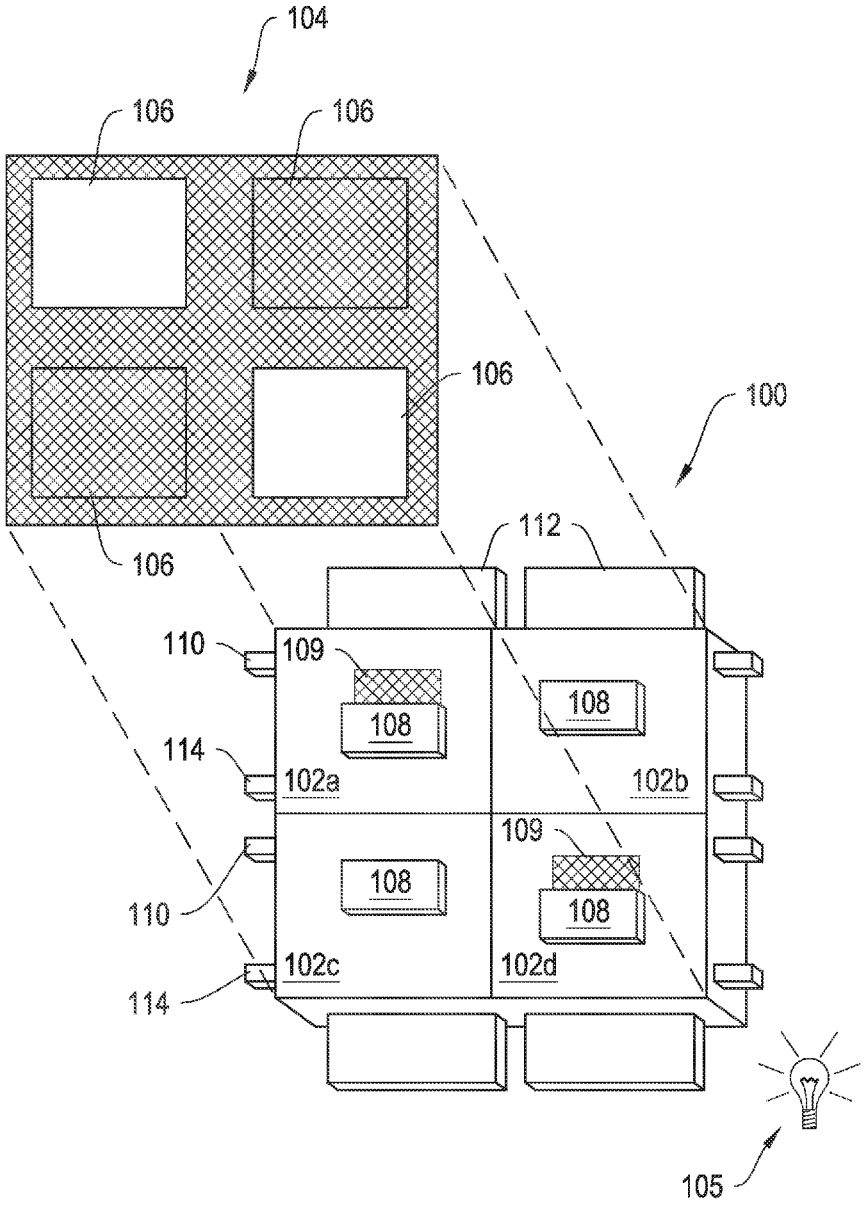
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (for example, e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

A display apparatus includes a cascode driver circuit for providing positive and negative polarities of two or more voltages at an output node. The voltages provided by the cascode driver circuit can be used to provide voltages to various interconnects and terminals of the display apparatus. The cascode driver circuit includes a first circuit for providing a positive polarity of two or more voltages to an output node via a first set of cascode transistors. The cascode driver circuit also includes a second circuit for providing negative polarities of the two or more voltages to the output node via a second set of cascode transistors.

In some implementations, the first and the second circuits include body-effect mitigation circuitry for reducing the impact of body-effect on the performance of the driver circuit. The body-effect mitigation circuitry can selectively reduce a voltage difference between source and bulk terminals of one or more transistors of the cascode driver circuit to reduce body-effect.

In some implementations, the cascode driver circuit can include circuitry for reducing substrate leakage current. The circuitry can drive the gate terminal of one of the first set of cascode transistors so that substrate leakage current via that cascode transistor is reduced.

Particular implementations of the subject matter described in this disclosure can be implemented to realize one or more of the following potential advantages. By including cascode transistors in a drive circuit configured to provide positive and negative polarities of two or more voltages at an output node, the drive circuit can be fabricated using lower voltage processes, which reduces cost. In some implementations, transistors utilized in the driver circuits can include body-effect mitigation circuitry which can improve the switching speed of the driver circuit. In some implementations, the driver circuit can include circuitry for reducing substrate leakage currents within the driver circuit. By reducing the substrate leakage currents, power consumption of the driver circuit can be reduced.

FIG. 1A shows a schematic diagram of an example direct-view MEMS-based display apparatus 100. The display apparatus 100 includes a plurality of light modulators 102*a*-102*d* (generally light modulators 102) arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide a luminance level in an image 104. With respect to an image, a pixel corresponds to the smallest picture element defined by the resolution of image. With respect to structural components of the display apparatus 100, the term pixel refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or backlight so that each pixel can be uniformly illuminated. Transmissive direct-view displays are often built onto transparent or glass substrates to facilitate a sandwich assembly arrangement where one substrate, containing the light modulators, is positioned over the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (such as interconnects 110, 112 and 114), including at least one write-enable interconnect 110 (also referred to as a scan-line interconnect) per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the write-enabling voltage, $V_{WE}$), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
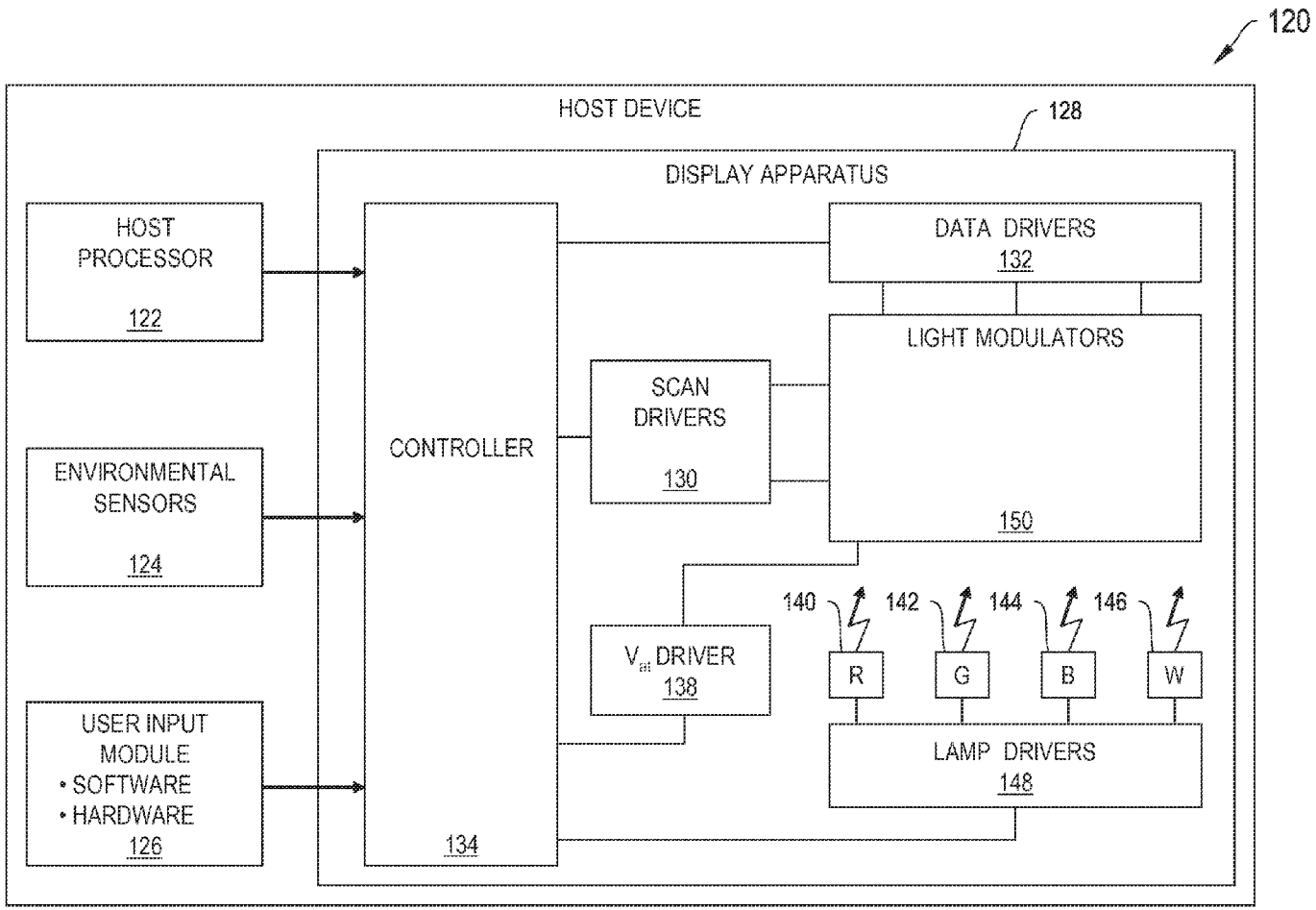
FIG. 1B shows a block diagram of an example host device.

FIG. 1B shows a block diagram of an example host device 120 (i.e., cell phone, smart phone, PDA, MP3 player, tablet, e-reader, netbook, notebook, watch, etc.). The host device 120 includes a display apparatus 128, a host processor 122, environmental sensors 124, a user input module 126, and a power source.

The display apparatus 128 includes a plurality of scan drivers 130 (also referred to as write enabling voltage sources), a plurality of data drivers 132 (also referred to as data voltage sources), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the controller 134). The controller sends data to the data drivers 132 in a mostly serial fashion, organized in sequences, which in some implementations may be predetermined, grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (such as scan drivers 130, data drivers 132 and common drivers 138) for different display functions are time-synchronized by the controller 134. Timing commands from the controller coordinate the illumination of red, green, blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are light emitting diodes (LEDs).

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, blue and white. The image frames for each respective color are referred to as color subframes. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, blue and white.

In some implementations, where the display apparatus 100 is designed for the digital switching of shutters 108 between open and closed states, the controller 134 forms an image by the method of time division grayscale, as previously described. In some other implementations, the display apparatus 100 can provide grayscale through the use of multiple shutters 108 per pixel.

In some implementations, the data for an image 104 state is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations, the sequencing is organized by blocks, where, for a block, the data for only a certain fraction of the image 104 state is loaded to the array 150, for instance by addressing only every $5^{th}$ row of the array 150 in sequence.

In some implementations, the process for loading image data to the array 150 is separated in time from the process of actuating the display elements in the array 150. In these implementations, the display element array 150 may include data memory elements for each display element in the array 150 and the control matrix may include a global actuation interconnect for carrying trigger signals, from common driver 138, to initiate simultaneous actuation of shutters 108 according to data stored in the memory elements.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as deeper color, better contrast, lower power, increased brightness, sports, live action, or animation. In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2:
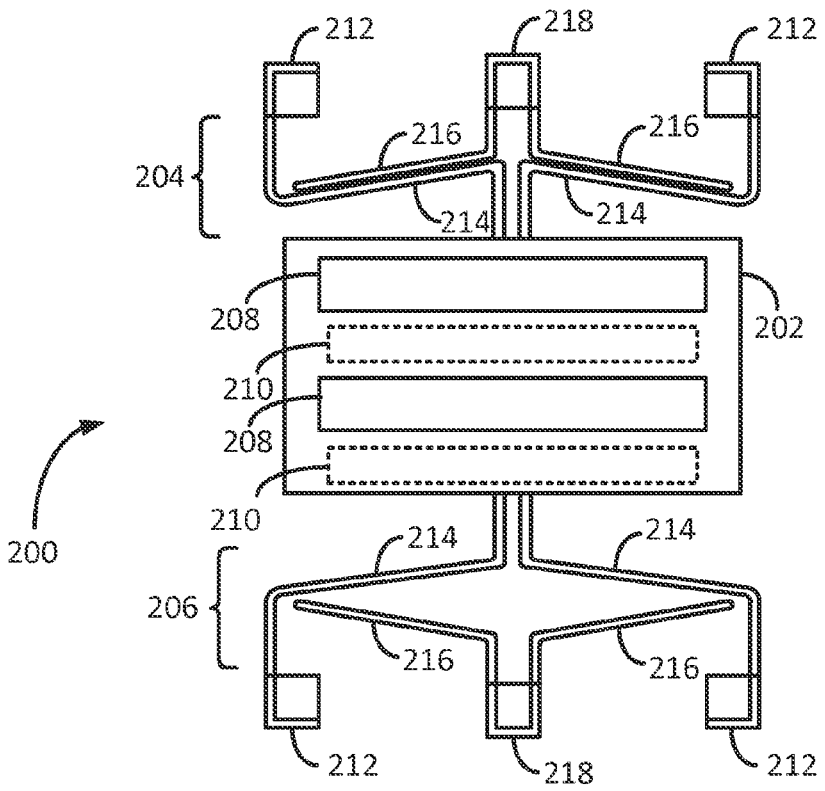
FIG. 2 shows a top view of an example shutter based light modulator 200.

FIG. 2 shows a top view of an example shutter based light modulator 200. In particular, FIG. 2 shows a light modulator 200 having actuators, each including two pairs of compliant beams. The light modulator 200 can include dual actuators for moving a shutter in opposing directions. The light modulator 200 can be suitable for incorporation into the direct view MEMS-based display apparatus 100 of FIG. 1A as the light modulator 102.

The light modulator 200 includes a shutter 202 coupled to a shutter-close actuator 204 and to a shutter-open actuator 206 (collectively referred to as "the actuators 204 and 206"). The shutter 202 includes shutter openings 208 through which light can pass through. By aligning or misaligning the shutter openings 208 with apertures 210 in an underlying aperture layer, the shutter 202 can transmit or block light emanating from the apertures 210 from reaching a viewer. When the shutter openings 208 are aligned with the apertures 210, the shutter 202 is said to be in an OPEN position. In the OPEN position, the shutter 202 allows substantially all light emanating from the apertures 210 to pass through towards the viewer. On the other hand, when the shutter openings are misaligned with the apertures 210, the shutter 202 is said to be in a CLOSED position. In the CLOSED position the shutter 202 blocks substantially all light emanating from the apertures 210 from reaching the viewer. In some implementations the shutter 202 can also be positioned in a partially CLOSED position, in which the shutter openings 208 are partially misaligned with the apertures 210. In the partially CLOSED position, the shutter 202 allows only a portion of the light emanating from the apertures 210 to reach the viewer. As an example, FIG. 2 shows the shutter 202 in a CLOSED position. That is, the shutter openings 208 are misaligned with the apertures 210.

The shutter 202 can be moved between the OPEN position and the CLOSED position by actuating the shutter-open actuator 206 and the shutter-close actuator 204. The shutter-open actuator 206 and the shutter-close actuator 204 are positioned on opposing ends of the shutter 202 such that the actuation of the shutter-open actuator 206 positions the shutter 202 in the OPEN position, while the actuation of the shutter-close actuator 204 positions the shutter 202 in the CLOSED position. The actuators 204 and 206 open and close the shutter 202 by pulling the shutter 202 substantially in a plane parallel to the aperture layer over which the shutter 202 is suspended. The shutter 202 is suspended a short distance over the aperture layer by load anchors 212 attached to the actuators 204 and 206. The inclusion of supports attached to both ends of the shutter 202 along its axis of movement reduces out of plane motion of the shutter 202 and confines the motion substantially to a plane parallel to the aperture layer.

As mentioned above, the shutter-close actuator 204 and the shutter-open actuator 206 each include two pairs of compliant beams. For example, each of the actuators 204 and 206 includes a pair of compliant load beams 214 and a pair of compliant drive beams 216. One end of each of the compliant load beams 214 is coupled to the shutter 202, while the other end of each of the compliant load beams 214 is coupled to the load anchor 212. One end of each of the drive beam 216 is coupled to a drive anchor 218 while the other end of each of the drive beams 216 is suspended in proximity with the opposing load beam 214.

The actuators 204 and 206 are actuated or de-actuated by applying or removing an actuation voltage across the compliant load beams 214 and the compliant drive beams 216. For example, to actuate the shutter-close actuator 204, a voltage difference equal to an actuation voltage is generated between the compliant load beams 214 and the compliant drive beams 216 of the shutter-close actuator 204. The application of the actuation voltage results in the generation of electrostatic forces between the compliant load beams 214 and the corresponding compliant drive beams 216. The electrostatic forces cause the compliant load beams 214, and in turn the shutter 202, to move towards the drive beams 216. As a result, the shutter 202 is positioned in a CLOSED state. Once the shutter-close actuator 204 has been actuated, the voltage difference between its compliant load beams 214 and the compliant drive beams 216 can be reduced to a lower maintenance voltage, which can maintain the position of the shutter over the presence of a greater opposing voltage being applied to the shutter-open actuator 206.

The shutter-open actuator 206 can be actuated in a manner similar to the one described above with respect to the shutter-close actuator 204. For example, assuming that the voltage on the shutter-close actuator 204 is less than the maintenance voltage referred to above, the shutter-open actuator 206 can be actuated by applying an actuation voltage across its compliant load beams 214 and the compliant drive beams 216. In this case, the shutter 202 is pulled in the opposite direction moving the shutter 202 into the OPEN position. After actuation, the voltage difference between the compliant load beams 214 and the compliant drive beams 216 of the shutter-open actuator 206 can be reduced to a maintenance voltage.

In some implementations, the voltage applied to the compliant load beams 214, and in turn the shutter 202, is kept constant. In such implementations, appropriate voltages can be applied to the respective compliant drive beams 216 of the actuators 204 and 206 based on which of the actuators 204 and 206 is to be actuated. For example, to actuate the shutter-close actuator 204, the voltage at the compliant load beams 214 and the shutter 202 can be maintained at zero volts and the voltage at the compliant drive beams 216 of the shutter-close actuator 204 can be raised to the actuation voltage.

In some other implementations, the voltage applied to the compliant drive beams 216 of both the actuators 204 and 206 are maintained at constant, but different voltages (such as a high voltage and a low voltage). In such implementation, an appropriate voltage is applied to the compliant load beams 214 and the shutter 202 to actuate one of the first actuators 204 and 206.

Figure 3:
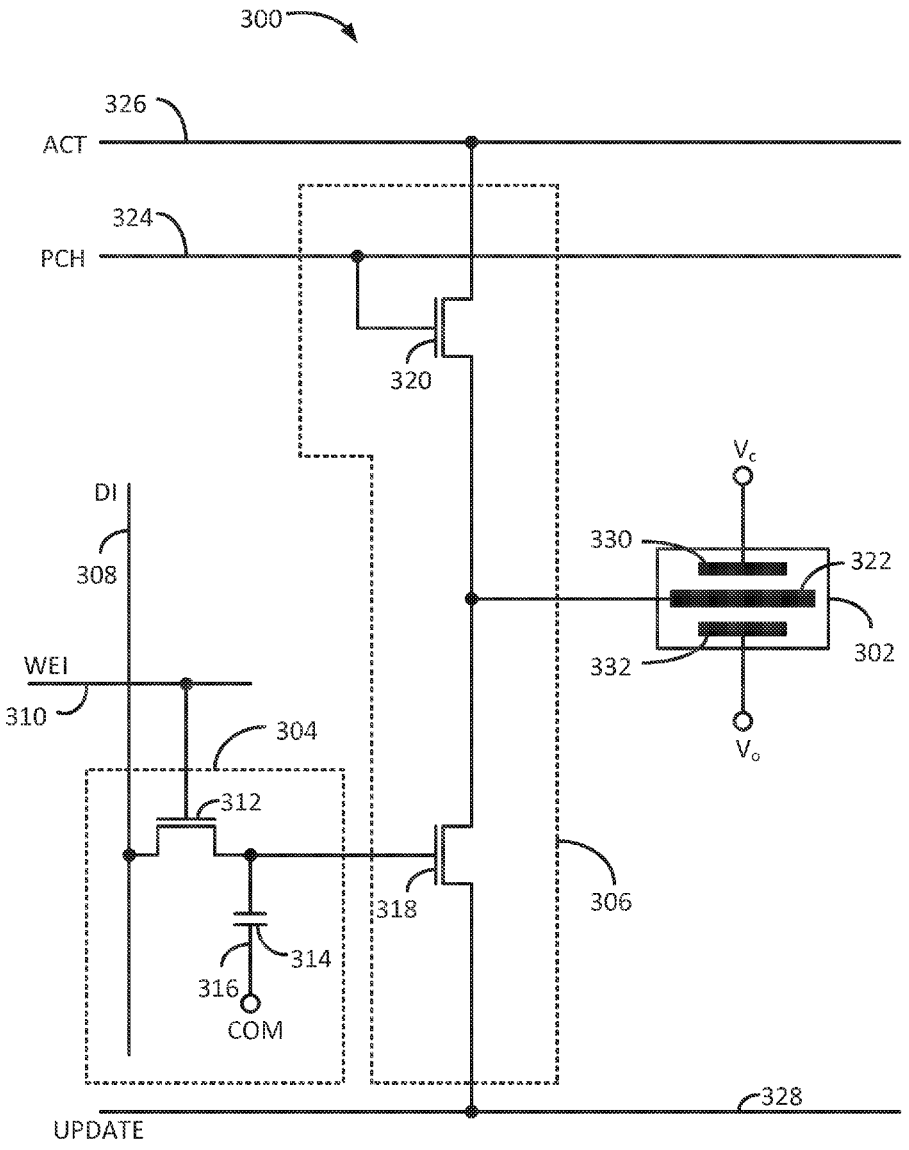
FIG. 3 shows an example pixel circuit 300 that can be implemented for controlling a light modulator.

FIG. 3 shows an example pixel circuit 300 that can be implemented for controlling a light modulator. In particular, the pixel circuit 300 can be used to control dual actuator light modulators, such as the light modulator 200 shown in FIG. 2. The pixel circuit can be part of a control matrix that controls an array of pixels that incorporate light modulators similar to the light modulator 200.

The pixel circuit 300 includes a data loading circuit 304 coupled to an actuation circuit 306. The data loading circuit 304 receives and stores data associated with the pixel, while the actuation circuit 306 actuates the light modulator 302 based on the data stored by the data loading circuit 304. In some implementations, various components of the pixel circuit 300 are implemented using thin film transistors (TFTs). In some implementations, TFTs manufactured using materials such as amorphous-silicon, indium-gallium-zinc-oxide (or other conductive oxides), or polycrystalline-silicon may be used. In some other implementations, various components of the pixel circuit 300 are implemented using metal-oxide semiconductor field-effect transistors (MOSFETs). As will be readily understood by a person having ordinary skill in the art, TFTs are three terminal transistors having a gate terminal, a source terminal, and a drain terminal. The gate terminal can act as a control terminal such that a voltage applied to the gate terminal in relation to the source terminal can switch the TFT ON or OFF. For n-type TFTs, if the voltage at the gate terminal exceeds the voltage at the source terminal by the threshold voltage, the n-type TFT would switch ON. On the other hand, for p-type TFTs, if the voltage at the gate terminal less than the voltage at the source terminal by the threshold voltage of the p-type TFT, then the p-type TFT would switch ON. In the ON state, the TFT (n-type or p-type) allows electrical current to flow between its source and drain terminals. However, in the OFF state, the TFT (n-type or p-type) substantially blocks any current flow between its source and drain terminals. The implementation of the pixel circuit 300, however, is not limited to TFTs or MOSFETs, and other transistors such as bipolar junction transistors also may be utilized.

As mentioned above, the data loading circuit 304 is used to load data associated with the pixel. Specifically, the data loading circuit 304 is coupled to a data interconnect (DI) 308, which is common to all the pixels in the same column of the array of pixels. The data interconnect 308 is energized with a data voltage corresponding to the data to be loaded into the pixel. In some implementations, the data voltage can be a voltage between a minimum data voltage, such as ground, and a maximum data voltage. In some such implementations, the minimum data voltage and the maximum data voltage can represent one bit of digital data, i.e., a '0' or a '1'. In some implementations, the data voltage can be a function of a pixel intensity value corresponding to that pixel.

The data loading circuit 304 is also coupled to a write enabling interconnect (WEI) 310, which is common to all pixels in the same row of the array as the pixel associated with the pixel circuit 300. When the write enabling interconnect 310 is energized with a write enabling voltage, the data loading circuit 304 accepts data provided on the data interconnect 308.

To accomplish the data loading function, the data loading circuit 304 includes a write enabling transistor 312 and a data storage capacitor 314. The write enabling transistor 312 can be a controllable transistor switch, the operation of which can be controlled by the write enabling voltage on the write enabling interconnect 310. The first terminal, or the gate terminal, of the write enabling transistor 312 can be coupled to the write enabling interconnect 310. The second terminal (drain/source terminal) of the write enabling transistor 312 can be coupled to the data interconnect 308, while the third terminal (drain/source terminal) can be coupled to the data storage capacitor 314. The data storage capacitor 314 can be used to store the data voltage that is representative of the data provided by the data interconnect 308. One terminal of the data storage capacitor 314 is coupled to the write enabling transistor 312, while the other terminal of the data storage capacitor 314 is coupled to a common interconnect (COM) 316. The common interconnect 316 provides a common ground voltage, or some other reference voltage, to pixels in multiple rows and columns of the display apparatus.

As mentioned above, the data loading circuit 304 is coupled to the actuation circuit 306. Specifically, the data storage capacitor 314 of the data loading circuit 304 is coupled to the gate terminal of a discharge transistor 318 of the actuation circuit 306. The actuation circuit 306 includes a charge path and a discharge path. The charge path includes a precharge transistor 320 and the discharge path includes the discharge transistor 318. The charge path and the discharge path are used to change a voltage applied to a shutter terminal 322 of the light modulator 302. The gate terminal of the precharge transistor 320 is coupled to a precharge interconnect (PCH) 324, while the other two (source/drain) terminals of the precharge transistor 320 are coupled to an actuation interconnect (ACT) 326 and to the shutter terminal 322 of the light modulator 302. When a precharge voltage is applied to the precharge interconnect 324, the precharge transistor switches ON, causing the shutter terminal 322 to be charge to an actuation voltage maintained on the actuation interconnect 326.

One of the source/drain terminals of the discharge transistor 318 is coupled to the shutter terminal 322 of the light modulator 302 while the other of the source/drain terminals is coupled to an update interconnect (UPDATE) 328. When a voltage on the update interconnect 328 is lowered, the discharge transistor 318 discharges the shutter terminal 322 based on the data voltage stored in the data storage capacitor 314. For example, if the data voltage stored in the data voltage capacitor is high, then the discharge transistor 318 can switch ON and discharge the shutter terminal 322. On the other hand, if the data voltage is low (i.e., below the threshold voltage of the discharge transistor 318), then the discharge transistor 318 can be switched OFF.

The light modulator 302, in addition to the shutter terminal 322, also includes a shutter-close actuator terminal 330 and a shutter-open actuator terminal 332. The shutter-close actuator terminal 330 and the shutter-open actuator terminal 332 can be coupled to dual actuators of a dual actuator light modulator. For example, referring to the dual actuator light modulator 200 shown in FIG. 2, the shutter-close actuator terminal 330 and the shutter-open actuator terminal 332 can be electrically coupled to the drive beams 216 of the first shutter-close actuator 204 and the first shutter-open actuator 206, respectively. Furthermore, the shutter terminal 322 can be coupled to the load beams 214 and the shutter 202.

The shutter-close actuator terminal 330 and the shutter-open actuator terminal 332 can be maintained at substantially constant but different voltages. For example, the shutter-close actuator terminal 330 can be maintained at a constant voltage of $V_c$, while the shutter-open actuator terminal 332 can be maintained at a constant voltage of $V_o$. The voltage on the shutter terminal 322, which is determined by the pixel circuit 300 based on the data voltage, determines which one of the light modulator's shutter-close actuator and the shutter-open actuator is actuated. In some implementations, if the voltage difference between the shutter terminal 322 and the shutter-close actuator terminal 330 is substantially equal to an actuation voltage, then the shutter-close actuator is actuated and the shutter is moved to a CLOSED position. On the other hand, if the voltage difference between the shutter terminal 322 and the shutter-open actuator terminal 332 is substantially equal to the actuation voltage, then the shutter-open actuator is actuated and the shutter is moved to an OPEN position. In some implementations, voltage $V_c$ can be maintained at a voltage that is equal to the actuation voltage while the voltage $V_o$ is maintained at ground or zero volts. In some other implementations, voltage $V_c$ can be maintained at zero volts while the voltage $V_o$ can be maintained at a voltage that is equal to the actuation voltage. In some other implementations, voltage $V_c$ and $V_o$ can be maintained at opposite polarities.

During operation, the actuation interconnect 326 can be maintained at an actuation voltage. At the beginning of a frame period (during which an image frame is displayed) the update interconnect 328 is brought to a high voltage that is sufficient to maintain the discharge transistor 318 in an OFF state irrespective of the voltage at the discharge transistor's 318 gate terminal. Subsequently, the data interconnect 308 is brought to a data voltage that corresponds to the data to be loaded into the pixel circuit and the write enable interconnect 310 is energized with a voltage that is sufficient to switch the write enable transistor 312 ON. This causes the data storage capacitor 314 to be charged or discharged such that the voltage on the data storage capacitor 314 is substantially equal to the data voltage.

After loading the data, the voltage on the precharge interconnect 324 is brought sufficiently high to switch the precharge transistor 320 ON. This causes the shutter terminal 322 to be charged to a voltage substantially equal to the actuation voltage. If the voltage $V_o$ at the shutter-open actuator terminal 332 is maintained at zero volts, the shutter-open actuator would be actuated, and the shutter would be moved into an OPEN position. On the other hand, if the voltage $V_c$ at the shutter-close actuator terminal 330 instead is maintained at zero volts, then the shutter-close actuator would be actuated, and the shutter would be moved into a CLOSED position. Thereafter, the voltage on the precharge interconnect 324 is brought sufficiently low to switch the precharge transistor 320 OFF. In some implementations, this voltage can be about ground voltage.

When the voltage on the update interconnect 328 is brought to a low level (typically less than the ground voltage) the discharge transistor 318 can assume a state based on the data voltage stored in the data storage capacitor 314. If the data voltage is sufficiently high to switch the discharge transistor ON, then the shutter terminal 322, which was previously precharged to the actuation voltage, is discharged via the discharge transistor 318. This causes the voltage on the shutter terminal 322 to be pulled low. As mentioned above, the voltage difference between the shutter terminal 322 and each of the shutter-open actuator terminal 330 and the shutter-close actuator terminal 332 determines which one of the dual actuators of the light modulator is actuated. Thus, for example, if the shutter voltage is pulled low, and Vc is being maintained at the actuation voltage, then the voltage difference between the shutter terminal 322 and the shutter-close terminal 330 will be equal to the actuation voltage. As a result, the shutter-close actuator would be actuated causing the shutter to move to a CLOSED position.

In some implementations, to reduce charge accumulation at the actuators, the magnitude of voltages $V_c$ and $V_o$ on the shutter-close actuator terminal 322 and the shutter-open actuator terminal 330 can be periodically reversed. For example, the $V_c$ can be maintained at near ground voltage while $V_o$ can be maintained at the actuation voltage. Thus, if the shutter voltage is pulled low, the shutter-open actuator would be actuated causing the shutter to move to the OPEN position. To maintain the relationship between the data input and the position of the shutter when the voltages on the shutter-close actuator terminal 322 and the shutter-open actuator terminal 330 are reversed, the data voltage on the data interconnect 308 can be inverted before being applied to the data loading circuit 304. In some implementations where voltages $V_c$ and $V_o$ are maintained at opposite polarities, the polarities of the voltages can be periodically reversed to reduce charge accumulation.

While FIG. 3 shows the pixel circuit 300 including only n-type transistors, in some other implementations, one or more transistors of the pixel circuit 300 may be a p-type transistor. In some implementations, all the transistors of the pixel circuit 300 may be p-type transistors. In some other implementations, the pixel circuit 300 may be configured such that one or more of the voltages provided to the pixel circuit 300 may be negative voltages. For example, the actuation voltage at the actuation interconnect 326, voltage at the update interconnect 328, voltage at the write enable interconnect 310, and the voltage at the common interconnect may be negative. In some implementations, the display apparatus may employ pixel circuits that are configured to operate with positive polarity voltages and pixel circuit that are configured to operate with negative polarity voltages. Thus, the display apparatus 100 would need to provide both positive and negative polarities of voltages used for the operation of the various configurations of the pixel circuit 300.

Figure 4:
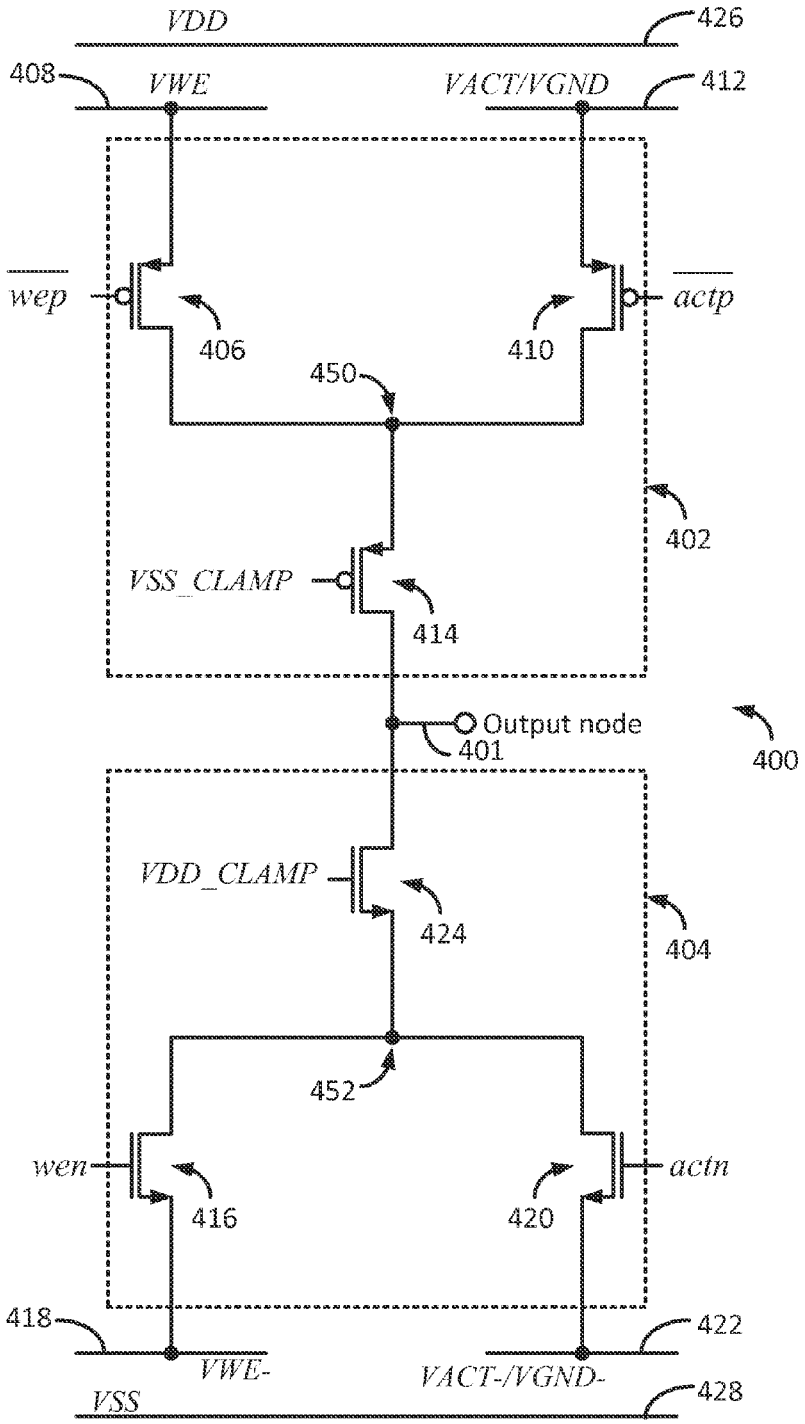
FIG. 4 shows an example cascode driver circuit for providing drive voltages to a display device.

FIG. 4 shows a cascode driver circuit 400 for providing drive voltages to a display device. For example, the cascode driver circuit 400 can be utilized to provide various drive voltages used for the operation of the display apparatus 120 shown in FIG. 1. In some implementations, the cascode driver circuit 400 can be utilized to provide positive and negative polarities of voltages needed for the operation of pixel circuits, such as pixel circuit 300 discussed above. The cascode driver circuit 400 can selectively provide various voltage levels at its output node 401. For example, the cascode driver circuit 400 can provide positive and negative polarities of each of an actuation voltage VACT, a ground voltage VGND and a write-enable voltage VWE at the output node 401. In some implementations, positive and negative polarities of additional voltages may also be provided by the cascode driver circuit 400.

In some implementations, the controller 134 of the display apparatus 128 (shown in FIG. 1B) may selectively couple the output node 401 to various interconnects at any given time to provide the desired voltage to that interconnect. For example, the output node 401 could be selectively coupled to the actuation interconnect 326 of the pixel circuit 300 for providing a positive or negative polarity of the voltage VACT to the actuation interconnect 326. At some other instance, the output node 401 may be selectively coupled to the write enable interconnect 310 of the pixel circuit for providing positive or negative polarities of the voltage VWE to the write enable interconnect 310. In some implementations, the display apparatus 128 may utilize more than one cascode driver circuits 400 for providing positive and negative polarities of various voltages to several interconnects.

The cascode driver circuit 400 includes a first circuit 402 for providing positive polarities of one or more source voltages to the output node 401. The cascode driver 400 also includes a second circuit 404 for providing negative polarities of the one or more source voltages to the output node 401. The source voltages can include, for example, an actuation voltage, ground voltage, a write-enable voltage, etc. In some implementations, the first circuit 402 and the second circuit 404 can be operated in a manner such that at any given time, only one source voltage is provided at the output node 401. In some implementations, such as the one shown in FIG. 4, the cascode driver circuit 400 can provide a positive write enable voltage (VWE), a positive actuation voltage (VACT), and a positive ground voltage (VGND), as well as a negative write enable voltage (VWE−), a negative actuation voltage (VACT−) and a negative ground voltage (VGND−) at the output node 401. However, it is understood that additional source voltages with negative, positive or both negative and positive polarities can be provided by the cascode driver circuit 400.

The first circuit 402 and the second circuit 404 employ switches for providing the desired positive polarity source voltage at the output node 401. For example, the first circuit 402 includes a first write-enable voltage transistor ("the VWE transistor") 406. The VWE transistor 406 operates as a switch, with its source terminal coupled to a positive write-enable voltage (VWE) source 408. The first circuit 402 further includes a first actuation/ground voltage transistor ("the VACT/VGND transistor") 410, also operating as a switch. The source terminal of the VACT/VGND transistor 410 is coupled to a positive actuation/ground voltage (VACT/VGND) source 412. The VACT/VGND voltage source 412 can, at any given time, provide either a positive actuation voltage VACT or a positive ground voltage VGND. In some implementations, the first circuit 402 may be coupled to separate VACT and VGND voltage sources. In some such implementations, the first circuit 402 can include separate VACT and VGND transistors coupled to the VACT and VGND voltage source, respectively.

In some implementations, the first circuit 402 may include additional transistors that are coupled to additional voltage sources. For example, the first circuit 402 may include an additional positive precharge transistor coupled to a positive precharge voltage source. By providing connectivity to additional positive voltage sources, the driver circuit 400 can selectively provide these additional positive polarity voltages at the output node 401.

The drain terminals of both the VWE transistor 406 and the VACT/VGND transistor 410 (and any additional transistor coupled to any additional voltage source) are coupled to the source terminal of a first cascode transistor 414 at a first cascode node 450. The drain terminal of the first cascode transistor 414 is coupled to the output node 401. As discussed further below, the first cascode transistor 414 reduces the voltage drop across the VWE transistor 406 and the VACT/VGND transistor 410. This reduction in the voltage drop allows the fabrication of the cascode driver circuit 400 using low voltage transistor fabrication processes.

In some implementations, one or more of the transistors employed in the first circuit 402 can be p-type MOSFETs. In some implementations, all the transistors in the first circuit 402 can be p-type MOSFETs.

Transistors in the first circuit 402 can be selectively switched ON or OFF based on the voltage desired at the output node 401. The gate terminal of the VWE transistor 406 is driven by a first write enable signal $\overline{\text{wep}}$, while the gate terminal of the VACT/VGND transistor 410 is driven by a first actuation signal $\overline{\text{actp}}$. Thus, to switch the VWE transistor 406 ON, the signal $\overline{\text{wep}}$ can be driven to be less than the voltage VWE by a magnitude equal to the threshold voltage of the VWE transistor 406. Similarly, to switch the VACT/VGND transistor 410 ON, the signal $\overline{\text{actp}}$ can be driven to be less than the voltage VACT/VGND by a magnitude that is equal to the threshold voltage of the VACT/VGND transistor 410. Furthermore, the gate terminal of the first cascode transistor 414 is maintained at a constant voltage VSS_CLAMP such that the first cascode transistor 414 is generally maintained in an ON state.

If the VWE voltage is desired at the output node 401, then the first write enable signal $\overline{\text{wep}}$ is driven to a low voltage, causing the VWE transistor 406 to switch ON and cause the first cascode node 450 to be pulled to the VWE voltage. As the first cascode transistor is also switched ON, the output node is also pulled to the VWE voltage. During the time that the VWE transistor 406 is switched ON, the VACT/VGND transistor 410 is maintained in an OFF state by applying a high voltage at the gate terminal of the VACT/VGND transistor 410 (i.e., maintaining the first actuation signal $\overline{\text{actp}}$ at a high voltage). On the other hand, if the VACT/VGND voltage is desired at the output node, the first actuation signal $\overline{\text{actp}}$ is driven to a low voltage, so that a low voltage is applied to the gate of the VACT/VGND transistor 410, causing it to switch ON. This, in turn, causes the first cascode node 450 and consequently the output node 401 to be pulled to the VACT/VGND voltage.

The second circuit 404, similar to the first circuit 402, employs switches for providing the desired negative polarity voltage at the output node 401. For example, the second circuit includes a second write-enable voltage transistor ("the VWE− transistor") 416. The VWE− transistor 416 operates as a switch, with its source terminal coupled to a negative write-enable voltage (VWE−) source 418. The second circuit 404 further includes a second actuation/ground voltage transistor ("VACT−/VWE− transistor") 420, also operating as a switch. The source terminal of the VACT−/VGND− transistor 420 is coupled to a negative actuation/ground voltage (VACT−/VGND−) source 422. The VACT−/VGND− voltage source 422 can, at any given time, provide either a negative actuation voltage VACT− or a negative ground voltage VGND−. In some implementations, the second circuit 404 may be coupled to separate VACT− and VGND− voltage sources. In some such implementations, the second circuit 404 can include separate VACT− and VGND− transistors coupled to the separate VACT− and VGND− voltage sources, respectively.

As mentioned above with respect to the first circuit 402, in some implementations, the second circuit 404 may include additional transistors that are coupled to additional voltage sources. For example, the second circuit 404 may include an additional negative precharge transistor coupled to a negative precharge voltage source. By providing connectivity to additional negative voltage sources, the driver circuit 400 can selectively provide these additional negative polarity voltages at the output node 401.

The drain terminals of both the VWE− transistor 416 and the VACT−/VGND− transistor 420 (and of any additional transistor coupled to any additional voltage source) are coupled to the source terminal of a second cascode transistor 424 at a second cascode node 452. The drain terminal of the second cascode transistor 424 is coupled to the output node 401. Similar to the first cascode transistor 414, which reduces the voltage drop across the VWE transistor 406 and the VACT/VGND transistor 410, the second cascode transistor 424 reduces the voltage drop across the VWE− transistor 416 and the VACT/VGND− transistor 420.

In some implementations, one or more of the transistors employed in the second circuit 404 can be n-type MOSFETs. In some implementations, all the transistors in the second circuit 404 can be n-type MOSFETs.

Transistors in the second circuit 404 can be selectively switched ON or OFF based on the voltage desired at the output node 401. The gate terminal of the VWE− transistor 416 is driven by a second write enable signal wen, while the gate terminal of the VACT−/VGND− transistor 420 is driven by a second actuation signal actn. The gate terminal of the second cascode transistor 424 is maintained at a constant voltage VDD_CLAMP such that the second cascode transistor 424 is maintained in an ON state.

Applying a high voltage at the gate terminal of the VWE− transistor 416 (i.e., driving the second write enable signal wen to a high voltage), causes the VWE− transistor 416 to switch ON, which in turn causes the second cascode node 452 and the output node 401 to be pulled to the voltage VWE−. If the VACT−/VGND− voltage is desired at the output node 401, then gate terminal of the VACT−/VGND− transistor is pulled to a high voltage (i.e., driving the second actuation signal actn to a high voltage). This causes the VACT−/VGND− transistor 420 to switch ON and causes the second cascode node 452 and the output node 401 to be pulled to the VACT−/VGND− voltage.

As mentioned above, the first cascode transistor 414 and the second cascode transistor 424 can be used to reduce voltage drops across transistors. For example, referring to the second circuit 404, the second cascode transistor 424 can reduce the voltage drops across the VWE-transistor 416 and the VACT−/VGND− transistor 420. The benefit of the second cascode transistor 424 can be explained by first demonstrating the voltage drop across the VWE-transistor 416 and the VACT−/VGND− transistor 420 in the absence of the second cascode transistor 424, and then showing the reduction in the voltage drop across these transistors in the presence of the second cascode transistor 424.

If the second cascode transistor 424 were absent, then the second cascode node 452 would be directly coupled to the output node 401. That is, the drain terminals of both the VWE− transistor 416 and the VACT−/VGND− transistor 420 would be directly coupled to the output node 401. Now assume that the output node 401 is coupled to one of the positive voltages provided by the first circuit 402. For example, assume that the output node 401 is coupled to VACT. While the output node 401 is coupled to VACT, the VWE− transistor 416 and the VACT−/VGND− transistor 420 would be switched OFF by pulling the second write enable signal wen and the second actuation signal actn to a low voltage. Thus, the drain terminals of the VWE− transistor 416 and the VACT−/VGND− transistor 420 would be at VACT. This means that the greatest voltage that can appear across the VWE− transistor 416 would be equal to VACT+VWE, while the greatest voltage that can appear across the VACT−/VGND− transistor 420 would be equal to VACT+VACT.

Assuming that the magnitude of VACT is greater than the magnitude of VWE, the greatest voltage that can appear across any transistor in the second circuit 404 would be equal to VACT+VACT. This means that the second circuit 404 (and therefore the cascode driver circuit 400) would have to be fabricated using a technology that provides transistors which can operate with a voltage drop of at least 2×VACT volts across their source and drain terminals. For example, in some implementations, the magnitude of the actuation voltage VACT can be equal to 20 V. This means that the greatest voltage across the VACT−/VGND− transistor 420 can be about 40 V. Thus, the circuit 400 without the second cascode transistor 424 would have to be fabricated in at least a 40 V fabrication process.

If however, by introducing the second cascode transistor 424 between the second cascode node 452 and the output node 401, the greatest voltage appearing across the VACT−/VGND− transistor 420 can be reduced. As shown in FIG. 4, the source terminal of the second cascode transistor 424 is coupled to the drain terminal of the VACT−/VGND− transistor 420 at the second cascode node 452. The gate terminal of the second cascode transistor 424 is maintained at a constant voltage of VDD_CLAMP. This means that the second cascode transistor 424 would switch OFF if the voltage at the second cascode node 452 increases to a level at which the difference between the voltage at the second cascode node 452 and VDD_CLAMP goes below the threshold voltage of the second cascode transistor 424. For example, assume that VDD_CLAMP is maintained at a voltage of 1 V and the voltage at the output node increases from an initial voltage of 0 V to 20 V (i.e., to VACT). As the voltage at the source terminal of the second cascode transistor 424 is less than 0 V, the second cascode transistor 424 is switched ON. This means that the voltage at the second cascode node 452 would be pulled to be substantially equal to the voltage at the output node 401.

As the voltage at the output node 401 increases, the voltage at the second cascode node 452 also increases. However, as the voltage at the second cascode node 452 increases to within the threshold voltage (of the second cascode transistor 424) from VDD_CLAMP (e.g., assumed above to be equal to 1 V), the second cascode transistor 424 switches OFF. As the second cascode transistor 424 is switched OFF, the second cascode node 452 is de-coupled from the output node 401. Thus, any further increase on the output node 401 does not affect the voltage on the second cascode node 452. In other words, the voltage at the second cascode node 452 is clamped at a highest voltage of VDD_CLAMP−$V_{thn}$, (where $V_{thn}$ is the threshold voltage of the second cascode transistor 424). Any further increase in the voltage at the output node 401 appears across the second cascode transistor 424.

Thus, by employing the second cascode transistor 424, the highest voltage attained by the drain of either the VWE− transistor 416 or the VACT−/VGND− transistor 420 is VDD_CLAMP−$V_{thn}$. The highest voltage drop appearing across the VWE− transistor would be VDD_CLAMP−$V_{thn}$+VWE, while the highest voltage drop appearing across the VACT−/VGND− transistor 420 would be VDD_CLAMP−$V_{thn}$+VACT.

As discussed above, the highest voltage drop across the VACT−/VGND− transistor 420 without the second cascode transistor 424 can be equal to about 2×VACT. However, by employing the second cascode transistor 424 the voltage drop across the VACT−/VGND− transistor would be equal to only about VDD_CLAMP−Vthn+VACT. Using the previously assumed example values of VDD_CLAMP and VACT to be 1 V and 20 V, respectively, the highest voltage drop appearing across the VACT−/VGND− transistor 420 can be 21 V−Vthn. As the threshold voltage Vthn of the second cascode transistor is typically less than 1 V, the highest voltage drop across the VACT−/VGND− transistor 420 would be about 20 V. Thus, the voltage drop across the VACT−/VGND− transistor 420, which absent the second cascode transistor 424 could be as high as 40 V, is reduced to about 20 V. Thus, the cascode driver circuit 400, instead of requiring fabrication in a 40 V process, can instead be fabricated in a 20 V process.

The first cascode transistor 414, in a manner similar to the second cascode transistor 424, also reduces the highest voltage drop across the VWE transistor 406 and the VACT/VGND transistor 410. Specifically, the first cascode transistor 414 allows the voltage at the first cascode node 450 to go no lower than VSS_CLAMP+$V_{thp}$, where $V_{thp}$ is the threshold voltage of the first cascode transistor 414.

As mentioned above, in some implementations, all transistors included in the driver circuit 400 can be MOSFETs. For example, all the transistors in the first circuit 402 can be p-type MOSFETs, while all the transistors in the second circuit 404 can be n-type MOSFETs. In some implementations, the bulk terminals of all the p-type transistors in the first circuit 402 are coupled to a positive supply voltage (VDD) 426, while the bulk terminals of all the n-type transistors in the second circuit 404 are coupled to a negative supply voltage (VSS) 428.

In some implementations, the performance of the driver circuit 400 may be adversely impacted by a relatively slow transition of the driver circuit 400 from providing a voltage with a first polarity to subsequently providing a voltage with an opposite polarity. For example, the cascode driver circuit 400 may suffer from slow transition when switching from providing VACT− voltage to subsequently providing VACT voltage to the output node 401 or vice versa. In some implementations, these slow transitions may be caused by high output impedances of the VACT/VGND transistor 410 and the VACT−/VGND− transistor 420. The high output impedances, in turn, may be caused due to body-effect.

Generally, body-effect results from the presence of a voltage difference between the bulk terminal and the source terminal of a transistor. As mentioned above, the bulk terminal of the VACT/VGND transistor 410 is tied to the VDD source 426. However, the source terminal of the VACT/VGND transistor 410 is coupled to VACT/VGND source 412. Thus a voltage difference exists between the source and the bulk terminals of the VACT/VGND transistor 410. This voltage difference may cause body-effect in the VACT/VGND transistor 410. Similarly, the VACT−/VGND− transistor 420 may also suffer from body-effect due to the voltage difference between its bulk terminal (coupled to VSS source 428) and its source terminal (coupled to VACT−/VGND− 422). In a similar manner, body-effect can also affect the performance of the VWE transistor 406 and the VWE− transistor 416.

Figure 5:
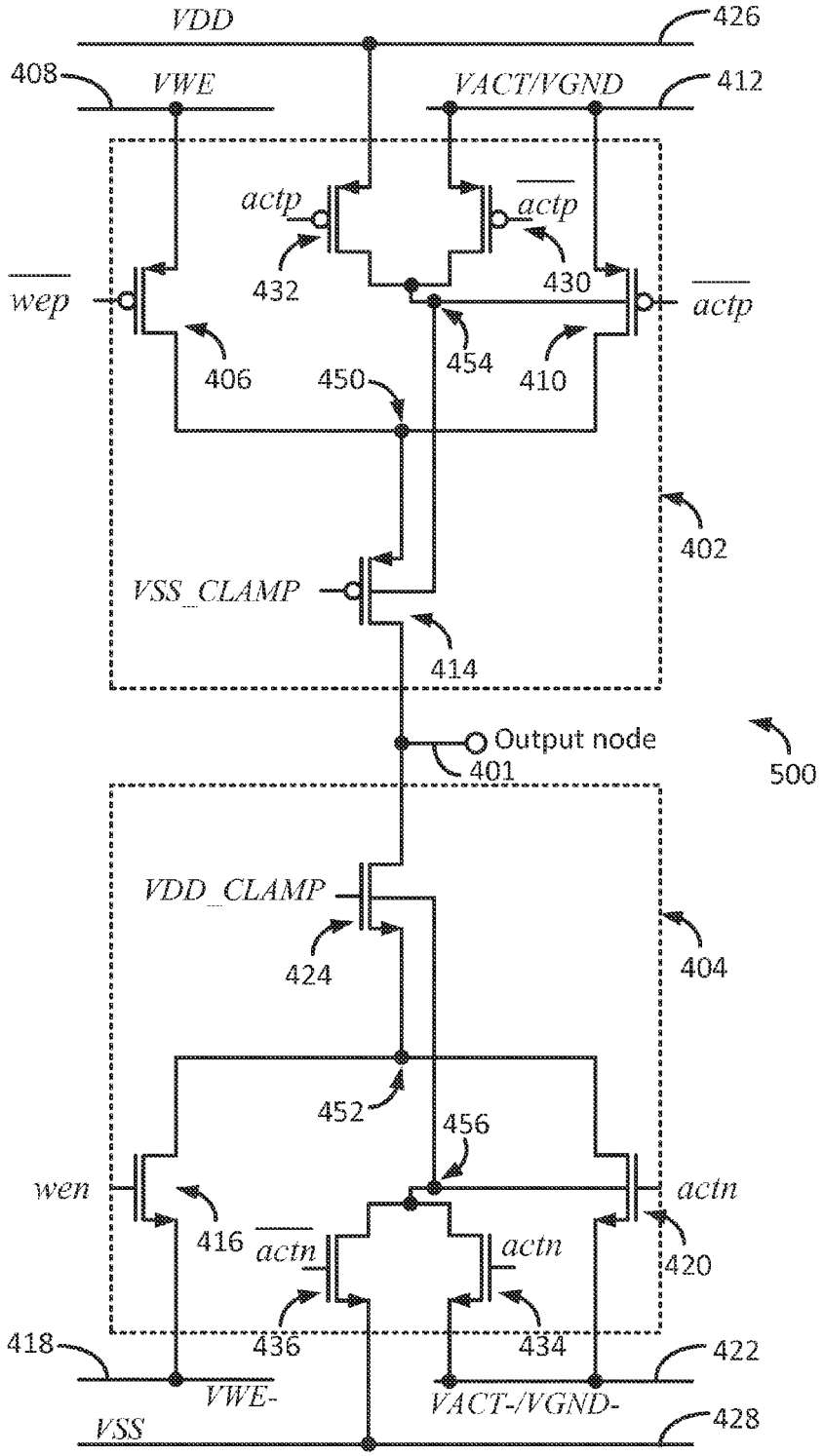
FIG. 5 shows an example cascode driver circuit having body-effect mitigation circuitry.

FIG. 5 shows a cascode driver circuit 500 having body-effect mitigation circuitry. In particular, the first circuit 402 includes first and second body-effect transistors 430 and 432 for mitigating the influence of body-effect on the operation of the VACT/VGND transistor 410. In addition, the second circuit 404 includes third and fourth body-effect transistors 434 and 436 for mitigating the influence of body-effect on the operation of the VACT−/VGND− transistor 420. The drain terminals of both the first and second body-effect transistors 430 and 432 are coupled to the bulk terminal of the VACT/VGND transistor 410 and the bulk terminal of the first cascode transistor 414 at the first bulk node 454. The source terminal of the first body-effect transistor 430 is coupled to VACT/VGND source 412, while the source terminal of the second body-effect transistor 432 is coupled to the VDD source 412. The drain terminals of the third and fourth body-effect transistors 434 and 436 are coupled to both the bulk terminal of the VACT−/VGND− transistor 420 and the bulk terminal of the second cascode transistor 424 at the second bulk node 456. The source terminal of the third body-effect transistor 434 is coupled to the VACT−/VGND− source 422 and the source terminal of the fourth body-effect transistor 436 is coupled to the VSS source 428.

The first and the second body-effect transistors 430 and 432 are driven by complementary signals $\overline{actp}$ and actp, respectively, such that only one of the first and second body-effect transistors 430 and 432 is switched ON at the same time. Furthermore, both the first body-effect transistor 430 and the VACT/VGND transistor 410 are driven by the same signal $\overline{actp}$. Thus, the first body-effect transistor 430 switches ON when the VACT/VGND transistor 410 switches ON. The third and fourth body-effect transistors 434 and 436 are also driven by complementary signals actn and $\overline{actn}$, respectively. In addition, the third body-effect transistor 434 is driven by the same signal, actn, which drives the gate terminal of the VACT−/VGND− transistor 420.

During operation, when the driver circuit 500 transitions from, for example, providing the negative write-enable voltage VWE− to providing the positive actuation voltage VACT to the output node 401, the VWE− transistor 416 is switched OFF and the VACT/VGND transistor 410 is switched ON. As the VACT/VGND transistor 410 and the first body-effect transistor 430 are driven by the same signal $\overline{actp}$, the first body-effect transistor 430 also switches ON. This causes the first bulk node 454 to be pulled to a voltage that is substantially equal to VACT. This in turn causes the bulk terminal of the VACT/VGND transistor 410 to be pulled to a voltage that is substantially equal to VACT. As the source terminal of the VACT/VGND transistor 410 is also coupled to the VACT/VGND 412, the voltage difference between the source and bulk terminals of the VACT/VGND transistor 410 is reduced to substantially zero volts. This reduces the body-effect on, and the output impedance of, the VACT/VGND transistor 410. This reduction in the output impedance increases the speed of transition of the cascode driver circuit 500.

In a similar manner, the bulk terminal of the first cascode transistor 414 is also pulled to a voltage that is substantially equal to VACT. The source terminal of the first cascode transistor 414 is also pulled to VACT due to the switching ON of the VACT/VGND transistor 410. Thus, the voltage difference between the source and the bulk terminals of the first cascode transistor 414 is reduced to substantially zero. As a result, the body-effect on, and the output impedance of, the first cascode transistor 414 is reduced. This reduction in the output impedance of the cascode transistor 414, in combination with the reduction in the output impedance of the VACT/VGND transistor 410, further improves the speed of transition of the cascode driver circuit 500.

When the VACT/VGND transistor 410 is switched OFF, the first body-effect transistor 430 is also switched OFF, while the second body-effect transistor 432 is switched ON, coupling the bulk terminal of the VACT transistor 410 back to the VDD interconnect 426.

The third and fourth body-effect transistors 434 and 436 reduce the body-effect on the VACT−/VGND− transistor 420 and the second cascode transistor 424. The third and fourth body-effect transistors 434 and 436 are driven by complementary signals such that only one of the third and fourth body-effect transistors is switched ON at the same time. The third body-effect transistor 434 is driven by the same signal actn that drives the VACT−/VGND− transistor, while the fourth body-effect transistor 436 is driven by the complementary drive signal $\overline{actn}$.

When the cascode driver circuit 500 transitions from, for example, providing a positive write enable voltage VWE to the output node 401 to providing the negative actuation voltage VACT−, the VWE transistor 406 is switched OFF while the VACT−/VGND− transistor 420 is switched ON by pulling the signal actn to a high value. As the signal actn is also coupled to the gate terminal of the third body-effect transistor 434, the third body-effect transistor 434 also switches ON, pulling the second bulk node 456 to VACT−. The fourth body-effect transistor 436 receives a complementary drive signal $\overline{actn}$, which is pulled to a low voltage. This causes the fourth body-effect transistor 436 to switch OFF. Thus, the bulk terminals of both the VACT−/VGND− transistor 420 and the second cascode transistor 424 are pulled to VACT−. As the source terminals of both these transistors are also at VACT−, the difference between their bulk and source terminals is substantially reduced to zero. As a result, the body-effect on the VACT−/VGND− transistor 420 and the second cascode transistor 424 is reduced, which also reduces their output impedance. Thus, when the cascode driver circuit 500 transitions from providing VWE to providing VACT− to the output node, the speed of transition is improved.

Figure 6:
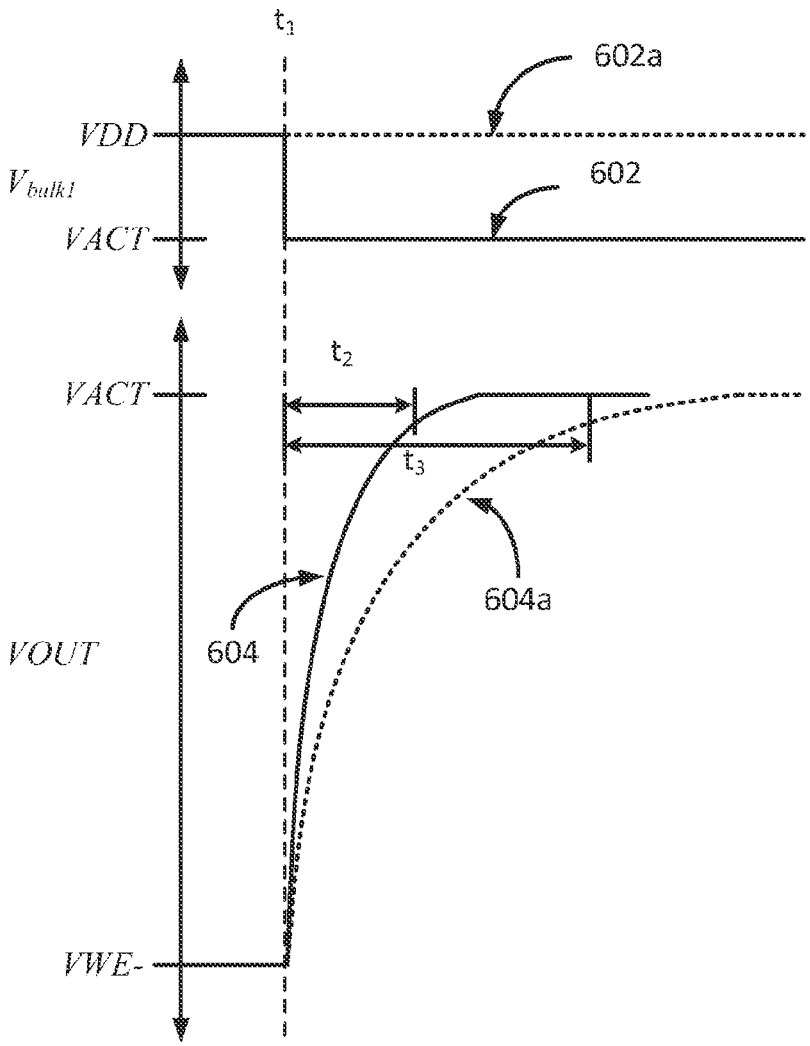
FIG. 6 shows example voltage waveforms for the cascode driver circuit shown in FIG. 5.

FIG. 6 shows example voltage waveforms for the cascode driver circuit 500 shown in FIG. 5. In particular, FIG. 6 shows the voltage $V_{bulk1}$ 602 at the first bulk node 454 and the output voltage VOUT 604 at the output node 401 when the cascode driver circuit 500 transitions from providing VWE− to providing VACT to the output node 401. To illustrate the benefit of the body-effect mitigation circuitry, FIG. 6 also shows (using broken lines) the voltage 602*a* at the bulk terminals of the VACT/VGND transistor 410 and the first cascode transistor 414 and the voltage 604*a* at the output node 401 if the cascode driver circuit 500 were not to include any body-effect mitigation circuitry. The relative voltage levels and time periods shown in FIG. 6 are for illustrative purposes only and have not been drawn to scale.

At time $t_1$, the cascode driver circuit 500 transitions from providing VWE− to providing VACT to the output node 401. Without the body-effect mitigation circuitry, the voltage 602*a* at the bulk terminals of the VACT/VGND transistor 410 and the first cascode transistor 414 would be maintained at VDD. As discussed above, this results in an increase in the output impedance of the VACT/VGND transistor 410 and the first cascode transistor 414, which slows the transition of the output voltage VOUT at the output node 401 from VWE− to VACT. Voltage 604*a* shows that the transition of the output voltage VOUT from VWE− to VACT without any body-effect mitigation circuitry takes $t_2$ seconds.

However, when the body-effect mitigation circuitry shown in FIG. 5 is utilized, the first body-effect transistor 430 is switched ON when the VACT/VGND transistor 410 is switched ON. This causes the voltage $V_{bulk1}$ 602 at the first bulk node 454 to be pulled from VDD to VACT. As discussed above, this reduces the body-effect on the VACT/VGND transistor 410 and the first cascode transistor 414, which in turn reduces the output impedance of these transistors. As a result, the transition of the output node from VWE− to VACT is relatively faster. As shown in FIG. 6, this transition takes $t_3$ seconds, which is less than duration $t_2$ associated with the transition when no body-effect mitigation circuitry is employed.

While not shown in FIG. 5, in some implementations, the cascode driver circuit 500 may further include body-effect mitigation circuitry for the VWE transistor 406 and the VWE− transistor 416 similar to the mitigation circuitry employed for the VACT/VGND transistor 410 and the VACT−/VGND− transistor 420. In some implementations, where the difference between the source voltage (e.g., VWE, VACT, and VGND) and the source voltage (e.g., VDD) is relatively small such that the body-effect on the respective transistor switch is negligible, no body-effect mitigation circuitry may be employed.

In some implementations, the cascode driver circuit 400 shown in FIG. 4 or the cascode driver circuit 500 shown in FIG. 5 may be manufactured using fabrication processes that have relatively lower n-well/p-well breakdown. In such implementations, to improve reliability, the bulk terminals of the first and second cascode transistors 414 and 424 may be coupled to their respective source terminals instead of being coupled to VDD interconnect 426 and the VSS interconnect 428, respectively. However, connecting the bulk terminals to the source terminals may result in a leakage current path from the substrate of the first cascode transistor 414 to the VWE− interconnect 418 or the VACT−/VGND− interconnect 422.

Figure 7:
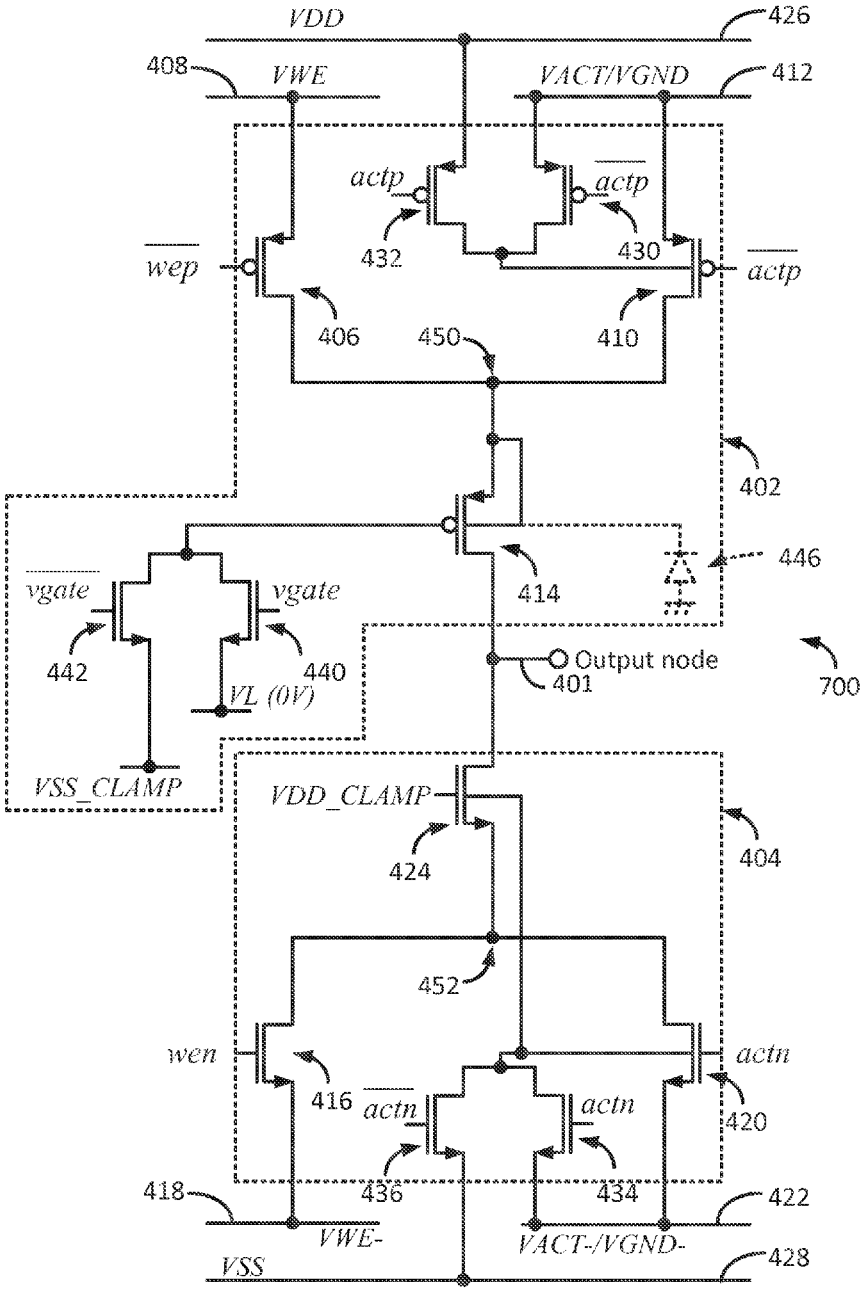
FIG. 7 shows an example cascode driver circuit having circuitry for reducing substrate leakage current.

FIG. 7 shows a cascode driver circuit 700 having circuitry for reducing substrate leakage current. In particular, the driver circuit 700 includes a first gate transistor 440 and a second gate transistor 442 coupled to the gate terminal of the first cascode transistor 414. FIG. 7 also shows an inherent diode 446 that may be formed by the n-well and the substrate of the p-type first cascode transistor 414. The anode of the diode 446 is coupled to the ground terminal (approximately 0 V) while the cathode is coupled to the bulk terminal of the first cascode transistor 414. Typically, the gate terminal of the first cascode transistor 414 is maintained at VSS_CLAMP, which is a negative voltage (e.g., VSS_CLAMP=−1 V). When the second circuit 404 is activated to provide voltages VACT−, VGND−, or VWE− to the output node 401, a current path from the anode terminal of the diode, via the drain terminal of the first cascode transistor 414 and via the second circuit 404 may be formed. This leakage current may undesirably increase the power consumption of the driver circuit 700 and/or may reduce the reliability of the driver circuit 700.

The first and second gate transistors 440 and 442 are used to mitigate the formation of the current leakage path discussed above. The first and second gate transistors 440 and 442 are driven by complementary signals vgate and $\overline{\text{vgate}}$, respectively, such that the gate terminal of the first cascode transistor 414 can be selectively driven by voltages VSS_CLAMP or VL. When the second circuit 404 is activated (i.e., when either the VACT−/VGND− transistor 420 or the VWE− transistor 416 is switched ON), the first gate transistor 440 is also switched ON. This causes the gate terminal of the first cascode transistor 414 to be pulled up to a voltage VL. Typically, the voltage VL is greater than VSS_CLAMP. In some implementations, the voltage VL can be zero volts. By driving the gate terminal of the first cascode transistor 414 with a relatively less negative voltage, the current leakage path is mitigated.

Figure 8:
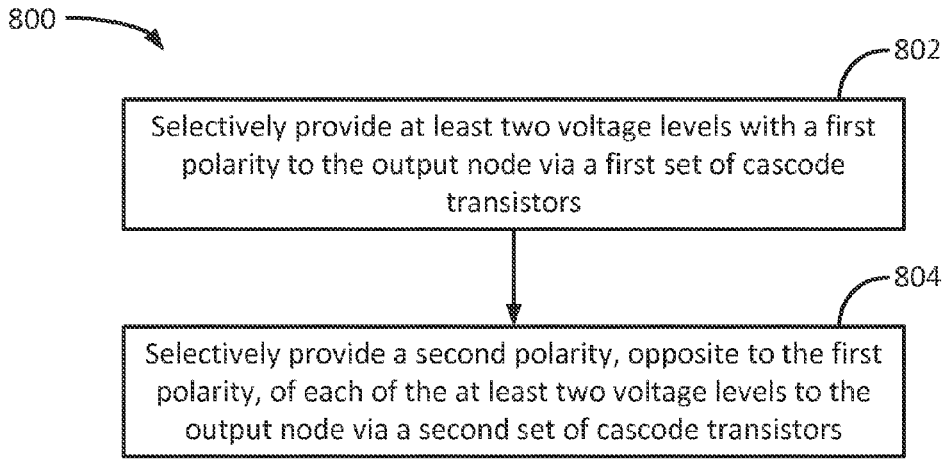
FIG. 8 shows an example flow diagram of a process for providing voltages at an output node.

FIG. 8 shows an example flow diagram of a process 800 for providing voltages at an output node. In particular the process 800 includes selectively providing at least two voltage levels with a first polarity to the output node via a first set of cascode transistors (stage 802), and selectively providing a second polarity, opposite to the first polarity, of each of the at least two voltage levels to the output node via a second set of cascode transistors (stage 804).

The process 800 includes selectively providing at least two voltage levels with a first polarity to the output node via a first set of cascode transistors (stage 802). One example of this process stage is discussed above in relation to FIGS. 4-7. In particular, FIGS. 4-7 show a first circuit 402 for providing positive polarities of the write enable voltage VWE, the actuation voltage VACT, and the ground voltage VGND. The positive polarity of the voltage VWE, for example, is provided to the output node 401 by switching ON the VWE transistor 406 and the first cascode transistor 414. Thus, the positive polarity of the write enable voltage VWE is provided to the output node via the cascode pair of the VWE transistor 406 and the first cascode transistor 414. Similarly, the VACT and VGND voltages are provided to the output node 401 via the cascode pair of VACT/VGND transistor 410 and the first cascode transistor 414.

The process 800 also includes selectively providing a second polarity, opposite to the first polarity, of each of the at least two voltage levels to the output node via a second set of cascode transistors (stage 804). One example of this process stage is discussed above in relation to FIGS. 4-7. In particular, FIGS. 4-7 show a second circuit 404 for providing negative polarities of the write enable voltage (VWE−), the actuation voltage (VACT−) and the ground voltage (VGND−). The VWE− voltage, for example, is provided via the VWE− transistor 416 and the second cascode transistor 424, while the VACT− and VGND− voltages are provided via the VACT−/VGND− transistor 420 and the second cascode transistor 414.

Figure 9A:
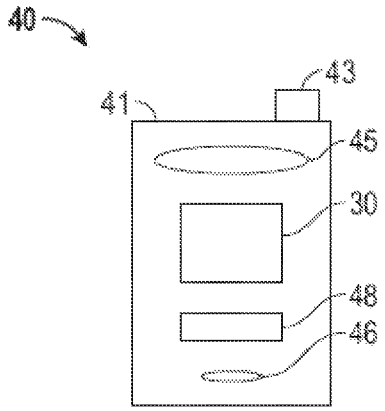
FIGS. 9A and 9B show system block diagrams of an example display device that includes a plurality of display elements.
Figure 9B:
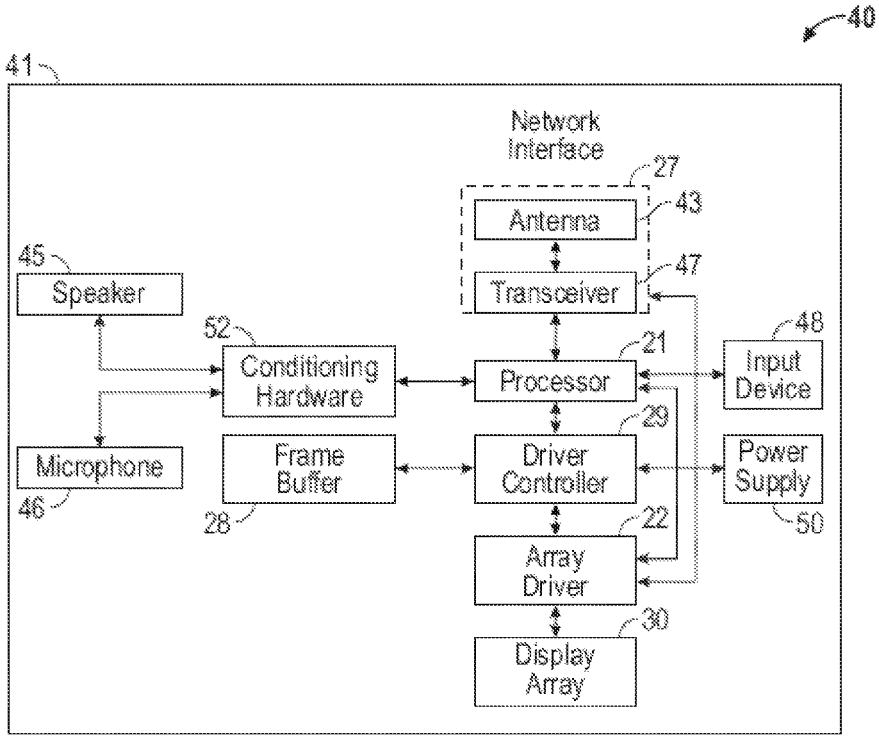

FIGS. 9A and 9B show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 9B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 9A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1×EV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus comprising:

an output node; and a driver circuit coupled to the output node including:

a first circuit, including a first set of cascode transistors, capable of selectively providing at least two voltage levels with a first polarity to the output node via the first set of cascode transistors, and a second circuit, including a second set of cascode transistors, capable of selectively providing a second polarity, opposite to the first polarity, of each of the at least two voltage levels to the output node via the second set of cascode transistors, wherein an input of at least one of the first set of cascode transistors, one terminal of which is connected to the output node, is provided with a first substantially constant voltage, and wherein an input of at least one of the second set of cascode transistors, one terminal of which is connected to the output node, is provided with a second substantially constant voltage, different from the first substantially constant voltage.

2. The apparatus of claim 1, wherein the first circuit includes a first switch capable of selectively coupling a bulk terminal of at least one of the first set of cascode transistors to substantially the same voltage as that of its source terminal.

3. The apparatus of claim 2, wherein the voltage at the source terminal of the at least one of the first set of cascode transistors is substantially equal to one of the at least two voltage levels with the first polarity.

4. The apparatus of claim 1, wherein the second circuit includes a second switch capable of selectively coupling a bulk terminal of at least one of the second set of cascode transistors to substantially the same voltage as that of its source terminal.

5. The apparatus of claim 4, wherein the voltage at the source terminal of the at least one of the second set of cascode transistors is substantially equal to the one of the at least two voltage levels with the second polarity.

6. The apparatus of claim 1, wherein the first circuit includes a switch capable of coupling both a bulk terminal and a source terminal of one of the first set of cascode transistors to a relatively lower magnitude voltage when the second circuit is providing the second polarity of one of the at least two voltage levels to the output node.

7. The apparatus of claim 1, wherein one of the first set of cascode transistors and one of the second set of the cascode transistors are directly coupled to the output node.

8. The apparatus of claim 1, wherein the first set of cascode transistors are p-type metal-oxide-semiconductor transistors and the second set of cascode transistors are n-type metal-oxide-semiconductor transistors.

9. The apparatus of claim 1, further comprising:

a display including:

an array of the display elements, one or more driver circuits, a processor that is capable of communicating with the display, the processor being capable of processing image data; and a memory device that is capable of communicating with the processor.

10. The apparatus of claim 9, the display further including:

a driver circuit capable of sending at least one signal to the display; and a controller capable of sending at least a portion of the image data to the driver circuit.

11. The apparatus of claim 9, further including:

an image source module capable of sending the image data to the processor, wherein the image source module comprises at least one of a receiver, transceiver, and transmitter.

12. The apparatus of claim 9, the display device further including:

an input device capable of receiving input data and to communicate the input data to the processor.

13. A method for providing voltages at an output node, comprising:

selectively providing at least two voltage levels with a first polarity to the output node via a first set of cascode transistors; and selectively providing a second polarity, opposite to the first polarity, of each of the at least two voltage levels to the output node via a second set of cascode transistors providing a first substantially constant voltage at an input of at least one of the first set of cascode transistors, one terminal of which is connected to the output node, and providing a second substantially constant voltage, different from the first substantially constant voltage, at an input of at least one of the second set of cascode transistors, one terminal of which is connected to the output node.

14. The method of claim 13, wherein selectively providing at least two voltage levels with a first polarity to the output node via a first set of cascode transistors includes selectively coupling a bulk terminal of at least one of the first set of cascode transistors to substantially the same voltage as that of its source terminal.

15. The method of claim 13, wherein selectively providing a second polarity, opposite to the first polarity, of each of the at least two voltage levels to the output node via a second set of cascode transistors includes selectively coupling a bulk terminal of at least one of the second set of cascode transistors to substantially the same voltage as that of its source terminal.

16. The method of claim 13, wherein selectively providing a second polarity, opposite to the first polarity, of each of the at least two voltage levels to the output node via a second set of cascode transistors includes coupling a bulk terminal and a source terminal of one of the first set of cascode transistors to a relatively lower magnitude voltage.

17. A driver circuit for providing a plurality of voltage to an array of display elements, comprising:

first means for selectively providing at least two voltage levels with a first polarity to an output node via a first set of cascode transistors; and second means for selectively providing a second polarity, opposite to the first polarity, of each of the at least two voltage levels to the output node via a second set of cascode transistors, wherein an input of at least one of the first set of cascode transistors, one terminal of which is connected to the output node, is provided with a first substantially constant voltage, and wherein an input of at least one of the second set of cascode transistors, one terminal of which is connected to the output node, is provided with a second substantially constant voltage, different from the first substantially constant voltage.

18. The driver circuit of claim 17, wherein the first and second means each includes one or more transistors, and the driver circuit further comprises means for reducing impact of body-effect of the one or more transistors.

19. The driver circuit of claim 17, further comprising:

a substrate on which the first means is resident on; and means for reducing a substrate leakage current of the first means.

* * * * *